US006316752B1

(12) United States Patent
Smetana et al.

(10) Patent No.: US 6,316,752 B1
(45) Date of Patent: Nov. 13, 2001

(54) HEATING ELEMENT WITH SCREEN-PRINTED AU-PD RESINATE LAYER AND AG-PD CONTACT AREAS WITH SOLDER RESISTANT DAMS

(75) Inventors: Walter Smetana; Karl Ochsenhofer, both of Vienna (AT)

(73) Assignee: Schaffler & Co., Gesellschaft mbH, Vienna (AT)

( * ) Notice: Subject to any disclaimer, the term of this patent is extended or adjusted under 35 U.S.C. 154(b) by 0 days.

(21) Appl. No.: 09/509,964

(22) PCT Filed: Oct. 2, 1998

(86) PCT No.: PCT/AT98/00233

§ 371 Date: May 10, 2000

§ 102(e) Date: May 10, 2000

(87) PCT Pub. No.: WO99/18586

PCT Pub. Date: Apr. 15, 1999

(30) Foreign Application Priority Data

Oct. 3, 1997 (AT) ..... 1677/97

(51) Int. Cl.[7] ..... H05B 3/16; H01C 17/065

(52) U.S. Cl. ..... 219/543; 219/541; 338/307; 29/620

(58) Field of Search ..... 219/543, 542, 219/541; 338/306–309, 327; 29/611, 620

(56) References Cited

U.S. PATENT DOCUMENTS

| | | | | |
|---|---|---|---|---|
| 2,761,945 | * | 9/1956 | Colbert et al. | 219/543 |
| 3,998,980 | | 12/1976 | Antes et al. | 427/103 |
| 4,138,605 | * | 2/1979 | Stapleton et al. | 219/543 |
| 4,241,103 | * | 12/1980 | Ohkubo et al. | 219/543 |
| 4,315,128 | * | 2/1982 | Matcovich et al. | 219/543 |
| 4,392,013 | * | 7/1983 | Ohmura et al. | 219/543 |
| 5,854,465 | * | 12/1998 | Kishi et al. | 219/216 |
| 6,084,208 | * | 7/2000 | Okuda et al. | 219/543 |

FOREIGN PATENT DOCUMENTS

| | | | |
|---|---|---|---|
| 405 591 | | 10/1997 | (AT) . |
| 2 020 016 | | 4/1970 | (DE) . |
| 248 977 | | 12/1987 | (EP) . |
| 471 138 | | 2/1991 | (EP) . |
| 576 067 | | 6/1993 | (EP) . |
| 8-96939 | * | 4/1996 | (JP) . |
| 95/34083 | | 12/1995 | (WO) . |
| WO 96/01983 | | 1/1996 | (WO) . |

OTHER PUBLICATIONS

Japan Patent Abstract, vol. 014, No. 065 (E–0884), Feb. 6, 1990.

* cited by examiner

*Primary Examiner*—John A. Jeffery
(74) *Attorney, Agent, or Firm*—Darby & Darby

(57) ABSTRACT

For producing a heating element with a high heat-up rate and a predetermined resistance value for igniting airbag systems, a base member made of an aluminum oxide ceramic material is provided with a glass or glass ceramic coating. A layer of AuPd resinate is applied by screen printing over a large area of the ceramic coating which, if necessary, can be lapped and polished. The resinate layer is subsequently etched to form a resistive path having area-wise constrictions. The ends of the resistive path are subsequently contacted by a AgPd thick-film conductive paste, wherein the Pd content of a conductive paste determines the desired resistance value. After the thick-film conductive paste is dried and fired, the coated base member is subjected to a thermal treatment at temperatures in the range of 850–950° C. until the palladium in the resistor layer is uniformly distributed and the resistance value is stable. Thereafter, solder-resistant dams in the form of glass stripes are applied on the marginal edges of the AgPd contacts facing the resistive path, thereby decreasing the risk that the resistive path de-alloys in a subsequent soldering process.

14 Claims, 1 Drawing Sheet

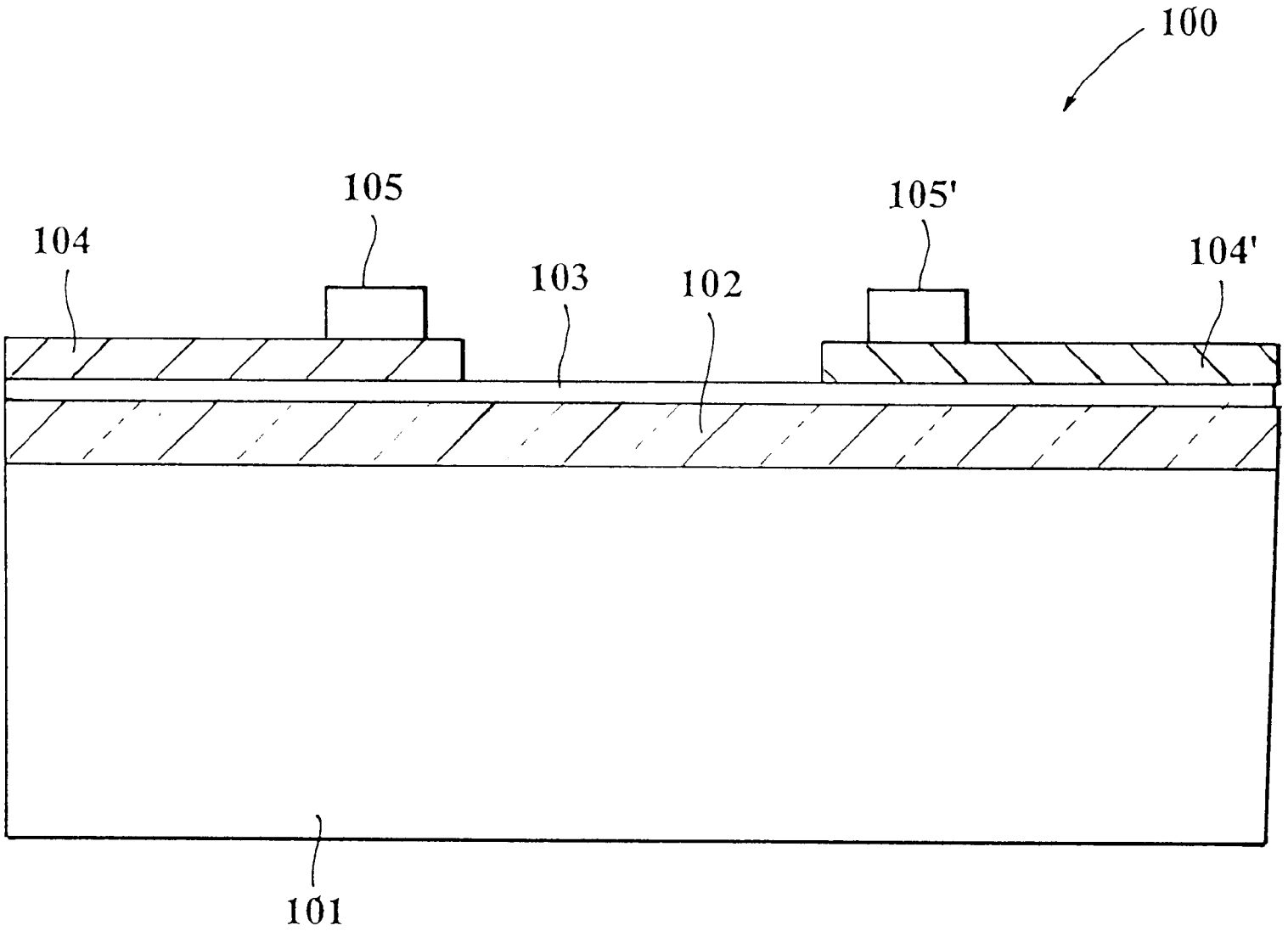
100
104'
105'
102
103
105
104
101

HEATING ELEMENT WITH SCREEN-PRINTED AU-PD RESINATE LAYER AND AG-PD CONTACT AREAS WITH SOLDER RESISTANT DAMS

BACKGROUND OF THE INVENTION

1. Field of the Invention

The invention relates to a method of producing a heating element which has a predetermined resistance value and a high heat-up rate. Such heating elements are desirable, for example, for igniting propellants for airbag systems. At present, such heating elements are made from resistor wires, with the diameter of the wires selected to be very thin (approximately 10 $\mu$m) in order to attain a high heat-up rate. The resistance value of a specified resistor wire having a predetermined wire length can only be varied by changing the cross-section of the wire. Since a wide spectrum of resistive values should be included, technical limits relating to the heat-up rate, ease of manipulation and installation of the wire will be reached quickly.

2. Description of the Related Art

U.S. Pat. No. 3,998,980 describes a thick-film resistor for thermal printer applications formed as a pixel element with a predetermined resistance value. The thick-film resistor consists of several printed layers applied on a ceramic substrate which is coated with a crystallizing glass forming a heat barrier. The resistor has a thickness in a range between 12.5 $\mu$m and 254 $\mu$m. The resistive material is a paste made of bismuth ruthenate. The smooth surface characteristics required of resistors used for printer elements can be obtained by lapping the resistor, with lapping being performed each time a printed layer has been applied or alternatively also as the last step in the process. Lapping is also used to adjust the resistance value and the temperature coefficient of the resistor. A subsequent annealing process is performed to prevent micro-cracks from developing in the resistor layer which could result in an increase in the resistance with aging. Disadvantageously, however, this type of resistor is formed as a thick-film resistor rather than as a thin-film resistor. Due to the large heat capacity of the resistor, the heat-up rate cannot be decreased below a certain value.

EP 0 471 138 A2 describes a method of producing an electric precision resistor with a predetermined temperature coefficient, wherein a platinum thin-film is applied on an aluminum oxide ceramic substrate. A layer consisting of a mixture which includes platinum resinate and rhodium resinate, is subsequently applied on the platinum thin-film, with the rhodium content determining the desired temperature coefficient. The coated substrate is subjected to a thermal treatment in the range of 1000° C. to 1400° C. until the rhodium is uniformly distributed in the formed resistor layer. The layer has a rhodium content in a range between 0.1% and 12% with respect to the combined content of platinum and rhodium. The temperature coefficient of precision resistors based on platinum alloys can be precisely adjusted in a range between 1600 and 3850 ppm/K by varying the rhodium content of the resistor layer. This method, however, is not intended to allow a precise adjustment the specific sheet resistance of the resistor layer.

WO 96/01983 A1 describes a method of producing a sensor for measuring temperature and/or flow, wherein the sensor is formed of a patterned resistor layer on a substrate. The resistor layer is a platinum rhodium film made of an annealed mixture of platinum resinate and rhodium resinate. For example, a platinum-rhodium resistor layer with a temperature coefficient of 3500 ppm/° C. can be realized by using a mixture of 99% platinum resinate paste and 1% rhodium paste. This method is also not intended to exactly adjust the specific sheet resistance of the resistor layer.

EP 0 576 017 A2 describes a method of producing an inkjet print head, wherein a thin-film layer forms a heating element which is heated to a temperature of 300° C. within several microseconds, and subsequently cools down again to room temperature. The contact areas of the thin-film heating elements are made of a Au resinate or a Pt resinate paste. These contact areas cannot be soldered. The thin film is made of a resinate paste containing, for example, metal alloys such as WNi, ZrCr, TaIr, TaFe or ZrNi. The main emphasis is here on the compatibility with ink; the reference does not address adjusting the specific sheet resistance.

DE-OS-2 020 016 discloses igniting means formed as a metal layer and disposed on an isolating element made of glass or ceramic. Two contact areas are applied to the isolating element by screen printing, using palladium-palladium silver from a palladium-gold, palladium-silver, nickel or silver-aluminum thick-film conductive paste, which is subjected to a sintering process between 1000° C. and 1100° C. A tantalum or tantalum nitride layer is subsequently evaporated and patterned by a photo lithographic process to form an ignition bridge which overlaps the marginal zones of the two contact areas. The length and width of the ignition bridge preferably ranges from 50 to 100 $\mu$m, with the thickness ranging from 0.2 $\mu$m to 1.5 $\mu$m. Disadvantageously, this process is rather complex because two different techniques, namely a thick-film technique (screen printing) and a thin-film technique (evaporation), are used. The photolithographic process for structuring the ignition bridge introduces additional problems in that the applied thick-film contact areas adversely affect the planarity of the surface. This unevenness can cause an insufficient exposure during contact printing processes which has the disadvantage of poorly reproducing the structure of the ignition bridge element.

The length of the heating element used to ignite propellants for airbag systems is specified by the dimensions available for installation in a suitable housing. When the layer thickness is specified, the resistance value of the resistor path can be increased only by reducing the width of the resistor. The width of the resistor cannot be decreased below a certain value because the resistor must have a minimum area to transfer the heat for reliably igniting the propellant.

SUMMARY OF THE INVENTION

It is an object of the invention to provide a method of producing a heating element, wherein a AuPd resinate resistor layer having a predetermined layer thickness is doped with Pd atoms so that the specific sheet resistance of the resistor layer can be adjusted to have a value in the range between 300 mΩ and approximately 3Ω.

In a preferred embodiment of the method, an aluminum oxide ceramic element is used as a substrate; alternatively, a steel substrate may also be used. A glass or glass ceramic coating is applied to the aforementioned substrate to form an intermediate layer which is both thermally and electrically conducting. The glass ceramic coating may consist of $SiO_2$, BaO, $Al_2O_3$ and an inorganic dye layer of a type which is commercially available from the company W. C. Heraeus GmbH, Hanau as a paste system under the name IP 211 or as an unfired ceramic foil under the name HERATAPE T5 or T211. The invention is based on the concept that the glass or glass ceramic coating which is applied to the ceramic or steel substrate as a thermal barrier, has to be lapped or polished, if necessary, to produce a resinate resistor layer which is uniform and can be reproducibly produced by wet chemistry. The dried and sintered glass or glass ceramic layer is lapped and polished until a mirror-like surface is produced. The AuPd thin-film resistor coating is subsequently applied to the substrate by a screen printing process. The applied coating material is preferably a resinate system, consisting of 22% Au by weight and 1% Pd by weight, which are distributed in a solution of resin and organic binders and are commercially available from the company W. C. Heraeus GmbH, Hanau under the name RP 26001/59. After application by screen printing, the resinate layer is dried at a temperature in a range between 100 and 150° C. and subsequently fired at a temperature in the range between 850 and 900° C., so that the organic solvents evaporate and/or are burned. The layer produced by this process has a thickness in the range between 0.1 and 1.5 μm. In a subsequent process step, the resistor layer is patterned, for example, by a wet chemical etching process or by sputter etching so as to form a strip having a narrow passage. The invention is based on the concept that depending on the pattern and length of the narrow passage, the temperature distribution on the resistive path can be purposely adjusted so that the peak temperature is reached at desired locations and regions of the resistive path. Contact areas for external connections are provided at both ends of the film resistor. The contact areas are also applied by screen printing using AgPd conductive pastes with different Pd fractions (Ag:Pd ratio between 1.7:1 and 26:1). Conductive pastes of this type are, for example, the AgPd conductive pastes of the series C1200 available from W. C. Heraeus GmbH, Hanau. The resistive path is doped with Pd through the AgPd contact areas. The invention is based on the concept that the resistance value of the resistive path made of a AuPd resinate layer can be modified to attain a specific value through contact with a AuPd thick-film metallic conductor layer having different Pd fractions. Depending on the Pd fractions in the AgPd conductive paste, the specific sheet resistance of the conductive path for a resistor having a length of 1 mm can be adjusted over the range from 310 mΩ to 3Ω by annealing: only the palladium fraction of the AuPd alloy of the thin-film resistor is varied, but not the layer thickness. A basic composition of a AgPd resinate paste with a higher Pd fraction cannot be produced for technical reasons.

The invention provides also a method of fabricating a heating element which has a high heat-up rate and includes a base member, a thermal isolation layer and a patterned resistor layer with contacts arranged on the isolation layer, by the following method steps:

printing a glass or glass ceramic paste (sintering temperature: 850° C. to 1100° C.) using a screen printing process for realizing a thermal isolation layer on an aluminum oxide or steel substrate;

drying the printed paste (at approximately 150° C.);

sintering the paste;

repeating the aforedescribed process steps on the same substrate until the desired total film thickness is achieved;

if necessary (surface too rough), lapping and polishing the sintered glass or glass ceramic coating until a mirror-like surface is attained;

annealing the substrate with the lapped and polished glass or glass ceramic coating to reduce mechanical stress which could result in micro-cracks;

printing the resinate paste on the glass or glass ceramic coating using a screen printing process;

drying the printed paste (between 80° C. and 150° C.); sintering the paste (850° C.);

patterning the resistive paths using a wet-etching processes or sputter etching;

printing the Pd-containing thick-film conductive pastes for contacting the resinate resistive paths on the lapped and polished glass or glass ceramic coating using a screen printing process;

drying the printed paste (at approximately 150° C.); and sintering the paste (between 850° C. and 950° C.).

A preferred embodiment of the present invention will be described hereinafter with reference to the drawing.

Other objects and features of the present invention will become apparent from the following detailed description considered in conjunction with the accompanying drawing. It is to be understood, however, that the drawing is intended solely for purposes of illustration and not as a definition of the limits of the invention, for which reference should be made to the appended claims.

The FIGURE shows a cross-sectional view of a heating element having a high heat-up rate according to a preferred embodiment of the present invention.

The heating element (100) includes a substrate (101) which can be provided with a lapped and polished glass or glass ceramic coating (102). A resinate resistive path (103) which is contacted by a thick-film conductive path metallization (104, 104') having an applied solder-resist dam (105, 105'), is arranged on the coating (102). In one particular embodiment, the substrate (101) is an aluminum oxide ceramic having a purity of 96–99%, with the remainder consisting of other oxides. A glass or glass ceramic coating (102) is applied on the substrate by screen printing using commercial paste systems available from the company HERAEUS or ESL. The employed pastes can preferably be sintered at a temperature of 850° C. If necessary, the surface roughness $R_a$ of the coating is reduced from >0.6 μm to <0.1 μm by a subsequent lapping and polishing process, so that a resistive path (103) with a uniform layer thickness can be built up on the coating without the formation of pores. The glass or glass ceramic coating provides a thermal barrier for the heating element, wherein the following process steps are implemented.

Printing the glass or glass ceramic paste on an aluminum oxide ceramic substrate with a layer thickness of approximately 80 μm using a screen printing process.

Drying the printed paste at 150° C. for approximately 10 minutes.

Sintering the dried paste in a continuous oven at a temperature of 850° C., which after the first firing cycle results in a glass or glass ceramic coating with a layer thickness of 15 μm.

Repeating the first three process steps on the same substrate until a total layer thickness of approximately 45 μm is achieved. This requires approximately three process cycles.

If necessary, lapping and polishing the glass or glass ceramic coating until a surface roughness of <0.1 μm is achieved.

Annealing the substrate at a high-temperature, preferably at 850° C. for 1 hour.

The temperature treatment reduces the mechanical stress induced by the lapping and polishing process which may otherwise cause the formation of micro-cracks in the glass or glass ceramic coating and subsequently also in the resinate resistive path. The resistive path should have a small heat capacity so as to heat up very quickly. This is achieved, on one hand, by selecting a metallization layer with a small heat capacity and/or by miniaturizing the resistive path. The resistive path (103) is fabricated from a AuPd or Au resinate paste using the following process steps.

Printing the resinate paste on the rough or lapped and polished glass or glass ceramic coating with a layer thickness of approximately 10 μm using a screen printing process.

Drying the printed paste at 150° C. for 10 minutes.

Firing the paste in a continuous furnace at 850° C., wherein after the firing cycle the metallization layer has a thickness of approximately 0.1 μm.

Patterning the resistive path by wet-chemical etching or by sputter etching.

The present invention is based on a concept that the resistance value of the AuPd or Au resinate resistance path can be controlled by forming a contact with AgPd-based thick-film conductive pastes (104, 104') and adjusting the Pd fraction. The following process steps should be followed:

Printing the AgPd or PdAu conductive thick-film paste with a layer thickness of approximately 30 μm so as to overlap the resistive path, using a screen printing process.

Drying the printed paste at 150° C. for 10 minutes. Sintering the dried paste in a continuous furnace at 850° C., wherein the layer thickness for contact formation is approximately 15 μm.

Annealing the substrate at a high-temperature, preferably 850° C., for approximately 1 hour.

Annealing changes the resistance value in a defined manner and subsequently stabilizes the resistance value.

If necessary, a glass paste is employed to apply solder-resist dams (105, 105') on the contacts of the thick-film conductive path (104, 104'). The solder-resist dams are intended to prevent wetting of the resistive path by the solder and the flux, when the wire connections are soldered, which could otherwise cause de-alloying and/or contamination of the resistive path. The following process steps is used to apply the solder-resist dam:

Printing a glass paste in the form of a stripe structure with a layer thickness of approximately 40 μm on the contacts of the conductive path, using a screen printing process.

Drying the printed paste at 150° C. for approximately 10 minutes.

Sintering the dried paste in a continuous furnace at a temperature of approximately 500° C.–600° C., which provides a layer thickness for contacting of approximately 25 μm.

The invention is not limited to the aforedescribed embodiment. The base member (101) can be made of high-temperature ferritic steel instead of aluminum oxide ceramic. The glass ceramic layer (102) can not only be applied by a screen printing process, but can also be laminated on the base member in the form of a "green" (unfired) ceramic foil and then sintered. It may not be necessary to apply a glass/glass ceramic layer if the base member itself is already a glass ceramic or a ceramic with a low thermal conductivity, for example zirconium oxide or magnesium oxide. However, the surface should be lapped and polished, if necessary, in order to achieve a surface roughness of <0.1 μm.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawing is not necessarily drawn to scale but that it is merely conceptual in nature. It is the intention, therefore, to be limited only as indicated by the scope of the claims appended hereto.

What is claimed is:

1. A heating element (100) with a high heat-up rate comprising (a) a base member (101);

(b) a patterned resistor layer (103) disposed on the base member (101);

(c) contact areas (104, 104') which are arranged on and overlapping with both ends of the resistive path (103);

(d) stripe-shaped solder-resist dams (105, 105') disposed on the contact areas (104, 104'), wherein the resistive path (103) is at least one of AuPd and Au resinate layer and the contact areas (104, 104') overlapping the resistive path (103) includes a thick-film conductive path metallization made of at least one of AgPd and PdAu.

2. The heating element (100) according to claim 1, wherein the base member (101) comprises 96% to 99% aluminum oxide with a residual fraction comprising other oxides.

3. The heating element (100) according to claim 1, wherein the base member (101) comprises a high-temperature-resistant glass, having a surface roughness of the base member is maintained at <0.1 μm through lapping and polishing.

4. The heating element (100) according to claim 3, wherein the high-temperature-resistant glass material is a glass ceramic material.

5. The heating element (100) according to claim 3, wherein the high-temperature-resistant glass is a ceramic material with a low thermal conductivity.

6. The heating element (100) according to claim 5, wherein the ceramic material with a low thermal conductivity is zirconium oxide.

7. The heating element (100) according to claim 1, wherein a thermal barrier (102) comprising a glass coating, is applied on the base member (101), with the surface roughness of the thermal barrier, if necessary, adjusted to <0.1 μm through lapping and polishing.

8. The heating element (100) according to claim 1, wherein the base member (101) comprising a high-temperature-resistant, low-carbon, chromium-containing steel.

9. The heating element (100) according to claim 1, wherein a thermal barrier (102) comprises a glass ceramic coating, is applied on the base member (101), with the surface roughness of the thermal barrier, if necessary, adjusted to <0.1 μm through lapping and polishing.

10. A Method of producing a heating element (100) having a high heat-up rate for igniting propellants, with a base member (101), a thermal barrier (102), a patterned resistor layer with or without a constriction (103) disposed on the thermal barrier (102), contact areas (104, 104') which are arranged on and overlapping with both ends of the resistive path (103), and stripe-shaped solder-resist dams (105, 105') disposed on the contact areas (104, 104'), comprising the steps of:

(a) printing the glass or glass ceramic paste by a screen printing process on an aluminum oxide ceramic substrate;

(b) drying the printed paste;

(c)sintering the dried paste;

(d) repeating the first three process steps on the same substrate until the desired layer thickness is achieved;

(e) providing a required surface roughness of the glass or glass ceramic coating;

(f) annealing the substrate to prevent the formation of micro-cracks;

(g) printing the AuPd or Au resinate resistive paste on the preferably lapped and polished glass or glass ceramic coating using a screen printing process;

(h) drying the printed paste;

(i) firing the resinate paste layer;

(j) patterning the resistor layer by wet-chemical etching or by sputter etching;

(k) printing the conductive paste so as to overlap the resistive path, using a screen printing process;

(l) drying the printed paste;

(m) sintering the dried paste;

(n) annealing the substrate to intentionally adjust and then stabilize the resistance value;

(o) printing the glass paste on the conductive path contacts in the form of a stripe-like structure, using a screen printing process;

(p) drying the printed paste; and (q) sintering the dried paste.

11. The method of producing a heating element (100) according to claim 10, wherein step (a) is replaced with a unfired glass ceramic foil applied to an aluminum oxide or steel substrate by lamination.

12. The method of producing a heating element (100) according to claim 10, wherein a AuPd resinate paste is used for the resistive path, wherein the AuPd resinate paste contains 22% Au by weight and 1% Pd by weight, with the remainder of the paste formed by an organic material.

13. The method of producing a heating element (100) according to claim 12, wherein for contacting the resistive path, a AgPd or PdAu thick-film conductive paste having a Pd fraction between 0% and 100% by weight is used, wherein the remainder comprises Ag or Au, an organic material, a glass phase and/or oxide additives.

14. The method of producing a heating element (100) according to claim 10, wherein a Au resinate paste is used for the resistive path, wherein the Au resinate paste contains 12% Au by weight, with the remainder of the paste formed by an organic material.

* * * * *